US007273012B2

(12) United States Patent
Melody

(10) Patent No.: US 7,273,012 B2
(45) Date of Patent: Sep. 25, 2007

(54) PROJECTILE FALL-BACK PREVENTER

(75) Inventor: Timothy E. Melody, Coon Rapids, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 11/148,968

(22) Filed: Jun. 9, 2005

(65) Prior Publication Data

US 2006/0278118 A1 Dec. 14, 2006

Related U.S. Application Data

(60) Provisional application No. 60/578,440, filed on Jun. 9, 2004.

(51) Int. Cl.
*F42B 14/00* (2006.01)

(52) U.S. Cl. ..... 102/524; 102/481

(58) Field of Classification Search ..... 102/520–528, 102/481; 162/481

See application file for complete search history.

(56) References Cited

U.S. PATENT DOCUMENTS

| | | | | |
|---|---|---|---|---|
| 3,613,596 | A * | 10/1971 | Walde | 102/525 |
| 4,047,466 | A | 9/1977 | Berman | |
| 4,441,429 | A | 4/1984 | Price et al. | |
| 4,552,071 | A | 11/1985 | Horais et al. | |
| 4,677,894 | A | 7/1987 | Pongratz et al. | |
| H794 | H | 7/1990 | Telmo et al. | |
| 6,369,373 | B1 | 4/2002 | Tepera et al. | |

* cited by examiner

*Primary Examiner*—Michael J. Carone
*Assistant Examiner*—Gabriel J. Klein
(74) *Attorney, Agent, or Firm*—Patterson, Thuente, Skaar & Christensen, P.A.

(57) ABSTRACT

A projectile for a large caliber gun including a fall-back preventer ring disposed within a fall-back preventer recess defined by the projectile. The fall-back preventer ring engaging the barrel of the large caliber gun during a loading cycle and releasing from the barrel when the projectile is fired. The fall-back preventer ring is a multifaceted split ring device sized for both axial and radial movement within the fall back preventer recess. The present invention thus maintains the projectile safely within the barrel during loading and in the presence of other external forces.

7 Claims, 5 Drawing Sheets

PROJECTILE FALL-BACK PREVENTER

RELATED APPLICATION

The present application claims the benefit of U.S. Provisional Application No. 60/578,440 filed Jun. 9, 2004, which is incorporated herein in its entirety by reference.

FIELD OF THE INVENTION

This invention relates in general to projectile retention devices for large caliber guns and in particular to a projectile with a split ring device that prevents the projectile from falling backward in a breech loading gun barrel during the loading cycle and subsequently locks into an aerodynamic position after the gun is fired.

BACKGROUND

The loading of a large caliber gun has always involved an element of danger. Most large caliber guns are loaded from the breech end of the gun barrel by one or more crewmembers. The ammunition generally includes one or more projectiles followed by one or more propellant charges. As the projectile and propellants are relatively heavy and typically explosive there is always a danger to the crew should they fall out of a gun during the loading cycle.

Typical large caliber guns have an interior barrel diameter that is greatest at the breech opening and then extends up the barrel to form a chamber. At the end of the chamber the diameter decreases at the forcing cone. The end of the forcing cone is the origin of the bore where interior barrel diameter remains constant for the remaining barrel length. Loading a large caliber gun first involves opening a breech block at the breech or aft end of the gun. The projectile is inserted into the chamber and rammed into place. The nose of the projectile is typically rammed past the forcing cone. Ramming of the ammunition into the barrel can be done manually or by mechanical means. Next, the propellant is placed in the breech behind the projectile, rammed into place and the breech is closed.

The loading process is a very dangerous stage in the firing cycle due to existence of unprotected bags of propellant and the live projectile. There is a danger that the projectile may fall out during the ramming cycle, as the barrel muzzle is typically elevated. There is also an inherent danger from the opposing forces that a hit or even a near-miss my shock the projectile out of the barrel while the breech is open. There is need therefore to prevent the ammunition from falling out of the barrel and into a crew area or crew compartment.

This issue has never been directly addressed in the prior art. In U.S. Pat. No. 4,677,894 leaf springs are employed to retain ammunition in the ammunition receiver, before it is transferred into the chamber of the gun. The ammunition is held by the free end of the leaf spring, but the leaf spring does not support the ammunition once the ammunition enters the cartridge chamber.

U.S. Statutory Invention Reg. No. H794 is directed toward a projectile rotating band for the aft end of a projectile. Among its functions, the band serves to retain the projectile in the forcing cone while it is being loaded, due to enhanced elasticity and friction coefficient of the band relative to the gun barrel. Likewise, U.S. Pat. No. 4,552,071 describes a two-piece de-spin obturator positioned at the aft end of a projectile. The obturator comprises a ring body with a wedge shaped cross-section. The friction created by the fit between the projectile and the outer surface of the obturator prevents the projectile from falling backwards into the breech as the gun is elevated to a more vertical position for firing. However, such devices, being located at the aft end of the projectile, do not engage the gun barrel as early as desirable. Moreover, these devices rely on a friction bond with the barrel rather than mechanical locking which is more reliable.

There is a need then for a projectile that will not fall-back during normal operation, or in the event of misfire, system power failure, rammer failure, high shock or hot gun environments. There is accordingly a need for a more reliable and robust device that will ensure stability of the projectile in such conditions.

SUMMARY OF THE INVENTION

The present invention is a projectile with a fall-back preventer for a breech loading gun. The fall-back preventer is located at a forward mating component of the projectile that allows the fall-back preventer to engage the bore or barrel as soon as the projectile is loaded into a gun barrel. The fall-back preventer uses spring pressure to keep the projectile from falling back, thereby allowing the present invention to operate under more extreme conditions than the prior art devices with greater reliability. The present invention provides a low cost, reliable, easily maintainable, non-aero drag-inducing feature that will prevent fall-back.

In a preferred embodiment, the fall-back preventer is a dual beveled split ring, similar to a piston ring. The outer diameter of the split ring is slightly larger than the gun bore inner diameter. The split ring is installed in a recess at a component mating joint as far forward as possible on the projectile body, thus allowing the projectile to be captured by the bore as soon a possible during the ramming cycle.

During loading, the fall-back preventer closes until the split ring outer diameter is the same as the gun bore inner diameter as the projectile is rammed through the forcing cone. Once the fall-back preventer passes the origin of bore in the gun barrel, the fall-back preventer is held in place against the gun bore by spring pressure.

A wedge lock device prevents the projectile from falling back once it has entered the bore. As the projectile is rammed further into the gun bore, the projectile obturator impacts the forcing cone causing the projectile to suddenly stop, but the fall-back preventer will continue to travel axially up the forward locking ramp that is located in the fall-back preventer recess, wedging itself between the gun barrel and the forward ramp wedge. When the propellant charge is ignited, the launching force on the projectile unlocks the fall-back preventer. The fall-back preventer is then forced into the rear locking wedge by the high setback acceleration forces, which permanently lock the fall back preventer in position against the rear locking wedge within the envelope of the projectile body.

Aside from this normal operation, the fall-back preventer is also effective during the rammer cycle. Once the fall-back preventer has passed the origin of bore, if there is a power failure or an incomplete rammer cycle the fall-back preventer will prevent the projectile from falling out of the gun barrel. This is accomplished by the weight of the projectile attempting to fall through the fall-back preventer, which is held stationary by spring pressure against the gun bore. The forward locking ramp wedge on the projectile would come in contact with the split ring causing further pressure against the gun bore, locking the projectile in place.

During a misfire operation that requires the replacement of the propellant charge, the fall-back preventer ensures that the projectile is firmly held in place while exchanging the propellant charge. If the system experiences a high-shock environment, as from a near miss from an opposing battery, the g-loads would act on the fall-back preventer, causing the device to lock tighter in the gun bore. The fall-back preventer has no components that would be affected by a hot gun environment. The fall-back preventer can be made from a number of suitable materials known in the art.

DETAILED DESCRIPTION OF THE PREFERRED EMBODIMENTS

Figure 1:
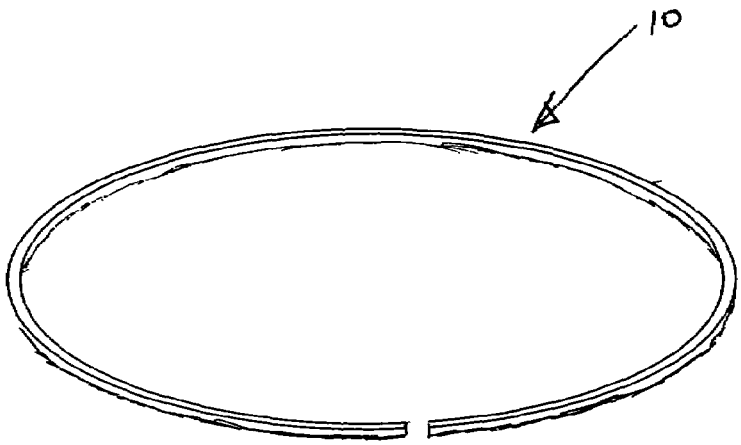
FIG. 1 is a perspective view of the fall-back preventer.
Figure 2:
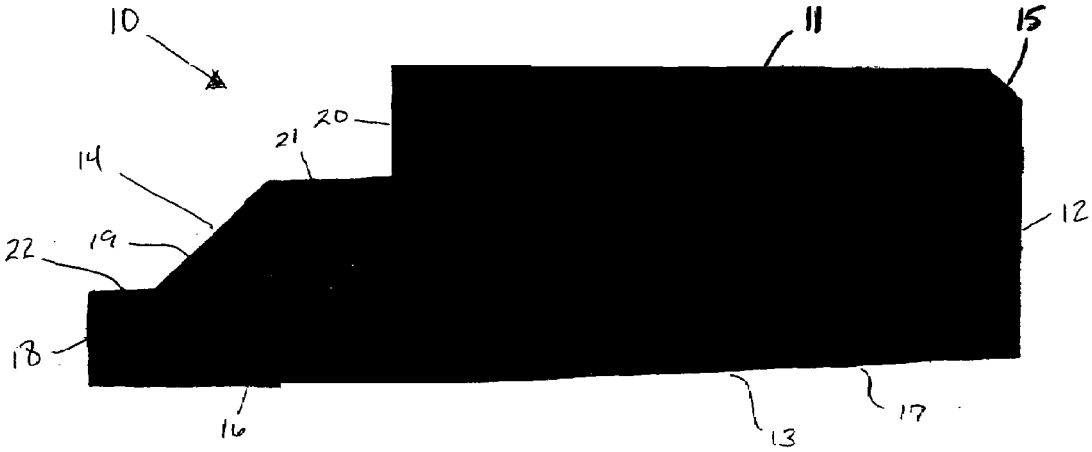
FIG. 2 is a cross-section view of the fall-back preventer.
Figure 3:
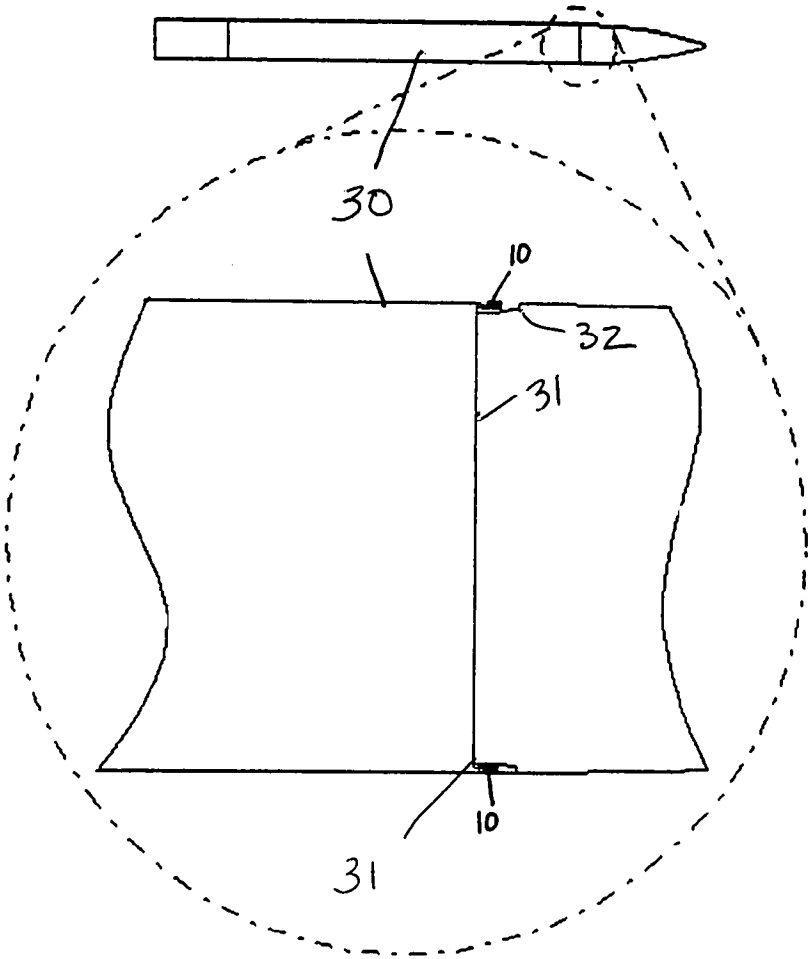
FIG. 3 is a cross section of a projectile with the fall-back preventer shown in exploded view.

This invention relates to a device that prevents a projectile from falling back through the breech of a breech loading gun barrel once it has been rammed into the forcing cone of the bore. As illustrated in FIG. 1, in a preferred embodiment, this invention is a fall-back preventer 10 shaped as a dual-beveled split ring with a cross-section as shown in FIG. 2. The operation of the fall-back preventer 10 is shown in FIGS. 3-9.

As illustrated in FIG. 2, the fall back preventer ring 10 includes a barrel engaging face 11, a forward edge 12, a projectile engaging face 13, and a staggered tail face 14. The barrel engaging face 11, forward edge 12, projectile engaging face 13, and staggered tail face 14 continue circumferentially about the fall back preventer 10 until interrupted by the split in the ring 10. The barrel engaging face 11 intersects the forward edge 12 at forward bevel face 15. Projectile engaging face 13 includes a tail section 16 that is generally parallel to barrel engaging face 11 and a sloped section 17 that intersects forward edge 12. The staggered tail face 14 includes projectile tail edge 18 that intersects tail section 16 of projectile engaging face 13, tail bevel face 19 and bore tail edge 20. Tail bevel face 19 is disposed between the bore tail extender face 21 and projectile tail extender face 22. Projectile tail edge 18 is generally parallel to forward edge 12. Bore tail extender face 21 and projectile tail extender face 22 are generally parallel to barrel engaging face 11.

As illustrated in FIGS. 3-9, the fall-back preventer 10 is installed at a component mating joint 31 as far forward as possible on the projectile body 30. Forward placement allows the projectile 30 to be captured by the bore as soon as possible during the ramming cycle. Component mating joint 31 includes fall back preventer recess 32 located circumferentially about the projectile 30. Fall-back preventer recess 32 includes a forward blocking face 33, a forward locking ramp 34 and a rear locking wedge 35.

Figure 5:
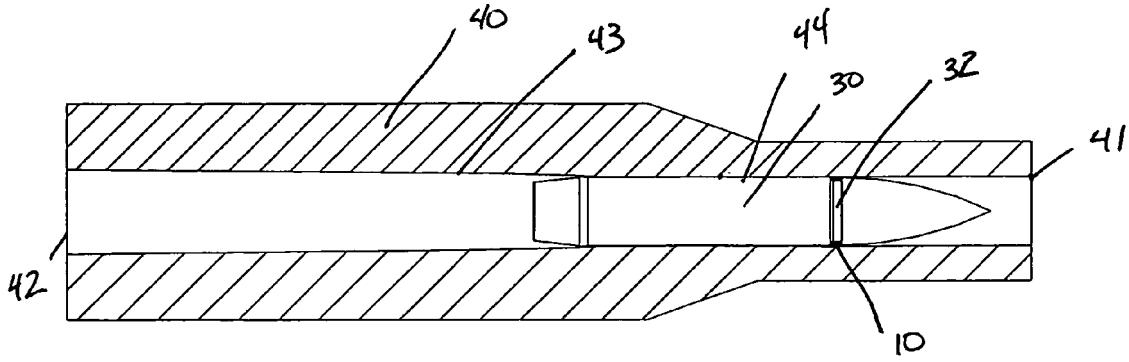
FIG. 5 is a cross section of the projectile with the present invention at the interface with the origin of the bore.
Figure 4:
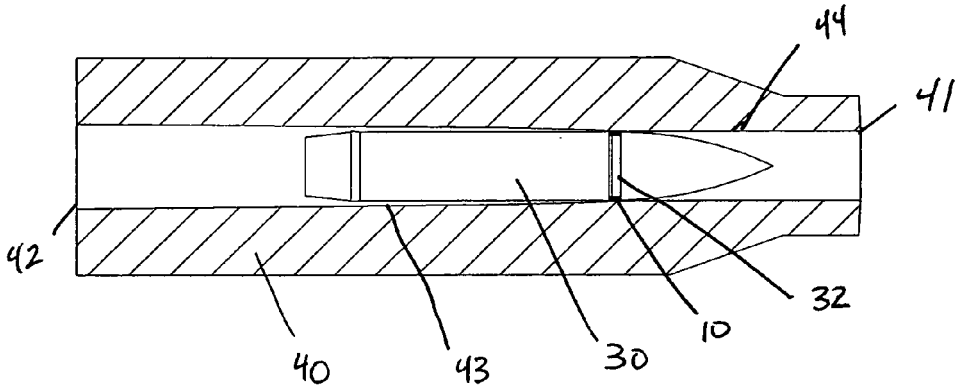
FIG. 4 is a cross section of the projectile with the present invention at the interface with the forcing cone.
Figure 6:
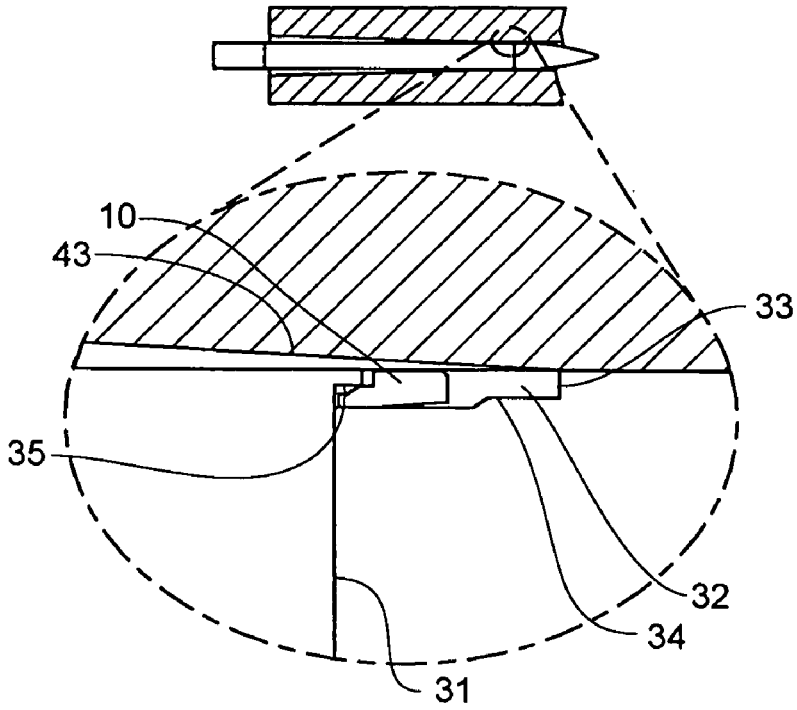
FIG. 6 is a cross section of a projectile with the fall-back preventer shown in exploded view at the interface with the forcing cone.

In operation, the projectile 30 is rammed into the breech of the gun 40 as illustrated in FIGS. 4-5. The inner diameter of gun 40 is referred to as the bore 41. The bore 41 includes a breech end 42 where the projectile 30 is inserted. As the projectile 30 moves up the bore 41 it encounters forcing cone 43, where the diameter of the bore 41 is reduced. At the distal end of the forcing cone 43 is the origin of bore 44, at which point the diameter of the bore 41 remains constant. During the ramming cycle, the fall-back preventer split ring 10 comes into contact with the forcing cone 43, as depicted in FIGS. 4 and 6, causing the split ring 10 to close until the split ring's outer diameter is the same as the gun bore 41 inner diameter. Once the fall back preventer 10 has passed the origin of bore 44, it is then held in place by spring pressure against the gun bore 41, see FIG. 5.

Figure 7:
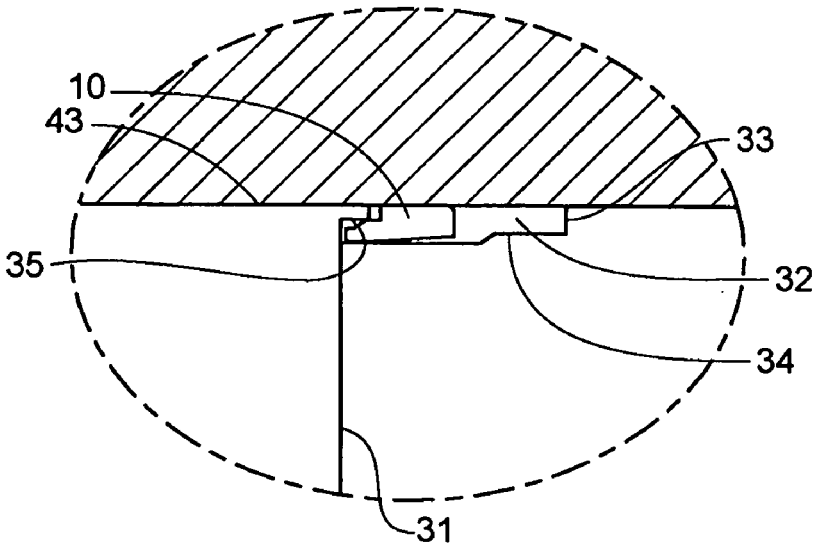
FIG. 7 is a cross section of a projectile with the fall-back preventer shown in exploded view at the interface with the origin of bore.

In normal operation, as the projectile 30 is rammed further into the bore 41, the obturator 36 (located near the aft end of the projectile 30) impacts the forcing cone 43. This causes the projectile 30 to suddenly stop, but the fall-back preventer ring 10 continues to travel up the forward locking ramp 34, wedging itself between the gun bore 41 and forward locking ramp 34, as shown in FIGS. 5 and 7. The projectile 30 is then prevented from falling back by this wedge lock. When the propellant charge is ignited, the forward movement of the projectile 30 unlocks the fall-back preventer 10.

Figure 9:
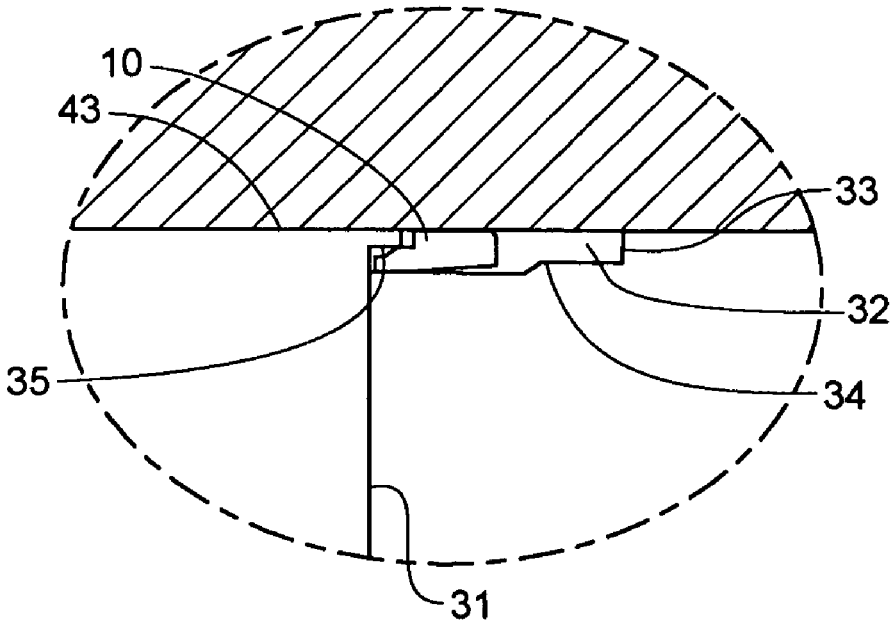
FIG. 9 is a cross section of a projectile with the fall-back preventer shown in exploded view where the fall-back preventer is in the locked "in flight" position.

To insure the aerodynamic qualities of the projectile, the fall-back preventer ring 10 must be locked within the envelope of the projectile 30 during flight. The fall-back preventer 10 is then forced into the rear locking wedge 35 by the high setback acceleration forces, which permanently lock the fall-back preventer 10 in that position as illustrated in FIG. 9.

Figure 8:
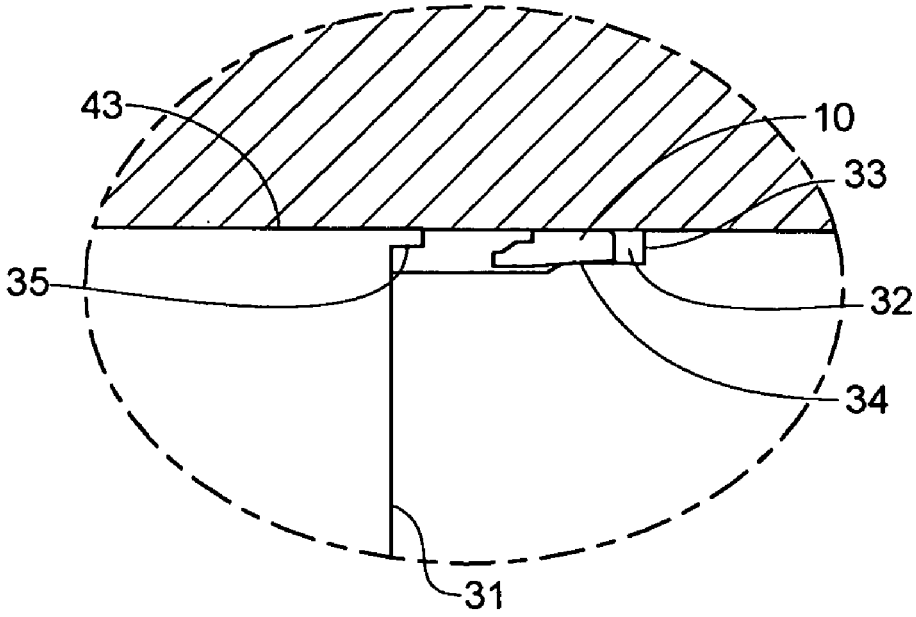
FIG. 8 is a cross section of a projectile with the fall-back preventer shown in exploded view once it is rammed beyond the origin of bore.

In the event of power failure or an incomplete rammer cycle, the fall-back preventer 10 keeps the projectile 30 from falling out of the gun bore 41. Once the fall-back preventer 10 has passed the origin of bore 44 the fall-back preventer 10 is held in place by spring pressure. The fall-back preventer 10 will therefore prevent fall-back even before the projectile 30 is fully loaded. As the projectile 30 starts to fall, the forward locking ramp 34 would come into contact with the fall-back preventer 10, causing further pressure against the gun bore 41, locking the projectile 10 in place in essentially the same position as illustrated in FIG. 8.

Although various embodiments of the present invention have been disclosed here for purposes of illustration, it should be understood that a variety of changes, modifications and substitutions may be incorporated without departing from either the spirit or scope of the present invention.

What is claimed is:

1. A projectile for a large caliber gun, the projectile including a fall-back preventer ring disposed within a fall-back preventer recess defined by the projectile, wherein the fall-back preventer ring is a multifaceted split ring device sized for both axial and radial movement within the fall-back preventer recess, the fall-back preventer ring including;

forward locking means to prevent the projectile from falling out of a barrel during a loading cycle, wherein said forward locking means include a projectile engaging face and a barrel engaging face separated by a forward edge, and rear locking means to maintain the fall-back preventer ring within the fall-back preventer recess during flight, wherein said rear locking means include a staggered tail face and a tail section separated by a projectile tail edge.

2. The projectile of claim 1 wherein the barrel engaging face further includes a forward bevel face, said forward bevel face disposed at an angle relative to the barrel for guiding the fall-back preventer ring into a locking position during ramming of the projectile into the barrel.

3. The projectile of claim 2 wherein the fall-back preventer recess is defined on an inboard side by a forward locking ramp, said forward locking ramp disposed to wedge the fall-back preventer ring into a locking position between the projectile and the barrel.

4. The projectile of claim 1 wherein the fall-back preventer recess is further defined on an aft side by a rear locking wedge, said rear locking wedge disposed to direct the fall-back preventer ring into a locking position as a result of firing the gun.

5. The projectile of claim 4 wherein the staggered tail face of the fall-back preventer ring includes an aft bevel face to further direct the fall-back preventer ring into the rear locking wedge.

6. The projectile of claim 1 wherein the fall-back preventer ring has a non-compressed outer diameter greater than the inner diameter of the bore at an origin of the bore.

7. The projectile of claim 6 wherein the fall-back preventer ring is compressed radially during the loading cycle by a gun barrel forcing cone disposed in the barrel between the breech and the origin of bore.

* * * * *